US007040027B1

(12) United States Patent
Shaffer et al.

(10) Patent No.: US 7,040,027 B1
(45) Date of Patent: May 9, 2006

(54) REAR PEEP SIGHT FOR MOUNTING TO A BOW STRING, HAVING INTERCHANGEABLE SIGHT PORTS FOR ACCOMMODATING USER PREFERENCES

(76) Inventors: Alfred H. Shaffer, Route 3, Box 233-1, Bruceton Mills, WV (US) 26525; Richard D. Shaffer, P.O. Box 265, Glenville, WV (US) 26351

( * ) Notice: Subject to any disclaimer, the term of this patent is extended or adjusted under 35 U.S.C. 154(b) by 0 days.

(21) Appl. No.: 10/795,928

(22) Filed: Mar. 8, 2004

(51) Int. Cl.
*F41B 5/00* (2006.01)

(52) U.S. Cl. ..... 33/265; 124/87

(58) Field of Classification Search ..... 33/265; 124/87
See application file for complete search history.

(56) References Cited

U.S. PATENT DOCUMENTS

| | | | | | |
|---|---|---|---|---|---|
| 3,410,644 | A | | 11/1968 | McLendon | |
| 3,703,771 | A | | 11/1972 | Saunders | |
| 4,011,853 | A | * | 3/1977 | Fletcher | 124/87 |
| 4,116,194 | A | * | 9/1978 | Topel | 124/87 |
| 4,656,747 | A | * | 4/1987 | Troncoso | 33/265 |
| 4,895,129 | A | * | 1/1990 | Hedgpeth | 124/87 |
| 4,934,332 | A | | 6/1990 | Scherz | |
| 4,961,264 | A | * | 10/1990 | Topel | 33/265 |
| 5,080,084 | A | | 1/1992 | Kendall et al. | |
| 5,148,603 | A | * | 9/1992 | Beutler | 33/265 |
| 5,157,839 | A | | 10/1992 | Beutler | |
| 5,325,598 | A | | 7/1994 | Hall et al. | |
| 5,347,976 | A | * | 9/1994 | Saunders | 124/87 |
| 5,379,747 | A | * | 1/1995 | Morris et al. | 124/87 |
| 5,860,408 | A | * | 1/1999 | Summers | 124/87 |
| 5,996,569 | A | | 12/1999 | Wilson | |
| 6,024,079 | A | * | 2/2000 | Ingle et al. | 127/87 |
| 6,170,164 | B1 | * | 1/2001 | Knowles | 33/265 |
| 6,282,800 | B1 | * | 9/2001 | Beutler | 33/265 |
| 6,628,464 | B1 | * | 9/2003 | Johnson | 124/87 |
| 6,860,021 | B1 | * | 3/2005 | Connelly, III | 33/265 |
| 2003/0019118 | A1 | * | 1/2003 | Wilson | 33/265 |

* cited by examiner

*Primary Examiner*—Yaritza Guadalupe
(74) *Attorney, Agent, or Firm*—Richard L. Miller, P.A.

(57) ABSTRACT

A rear peep sight for mounting to a string of a bow and having interchangeable sight ports for accommodating different user preferences. A mounting member mounts to the string of the bow and a sighting member is interchangeably attached to the mounting member so as to accommodate different user preferences of sight ports. The mounting member has a channel that slidably receives the sighting member so as to provide a dove-tail joint that prevents the sighting member from vertical movement, yet allows for horizontal movement so as to allow the sighting member to slide sideways into the channel. The sighting member has an auxiliary through bore and a pimple that align with, and engage with, respectively, a pair of through bores in the mounting member. A screw extends freely through one through bore in the mounting member and threadably into the auxiliary through bore so as to maintain prevention of the sighting member from horizontal movement.

29 Claims, 2 Drawing Sheets

REAR PEEP SIGHT FOR MOUNTING TO A BOW STRING, HAVING INTERCHANGEABLE SIGHT PORTS FOR ACCOMMODATING USER PREFERENCES

BACKGROUND OF THE INVENTION

1. Field of the Invention

The present invention relates to a rear peep sight for mounting to a string of a bow. More particularly, the present invention relates to a rear peep sight for mounting to a bowstring and having interchangeable sight ports for accommodating different user preferences.

2. Description of the Prior Art

Numerous innovations for bow sights have been provided in the prior art that will be described. Even though these innovations may be suitable for the specific individual purposes to which they address, however, they differ from the present invention.

A FIRST EXAMPLE, U.S. Pat. No. 3,410,644 to McLendon teaches telescopic sight means for a bow having an optical system comprising at least one optical lens sight means affixedlintegrally between the strands of the bowstring or mounted upon the bowstring, the lens preferably being sightingly aligned with a second optical lens sight affixed to the bow, whereby the target is magnified.

A SECOND EXAMPLE, U.S. Pat. No. 3,703,771 to Saunders teaches a bowstring-mounted peep sight including a body having vertically disposed side channels serving as housings and guides for carrying the strands of a divided multi-filament bowstring. A frame encircling the body of the sight and overlying the divided strands firmly embraces the peep sight body along opposed sides thereof, the frame including internally formed upper and lower bosses or hubs having axially disposed in-line passages adapted slidably to receive the bowstring therethrough, whereby the peep sight is conveniently secured on the bowstring in any selectable position. The body of the peep sight, adjacent the area of the sighting port, is provided with a grating-type surface contour to eliminate reflection and glare in the region of the port.

A THIRD EXAMPLE, U.S. Pat. No. 4,934,332 to Scherz teaches an archery bow peep sight designed to be mounted horizontally in a multi-stranded bowstring such that the axis of the peep is the same as the line of the bowstring. The peep sight is disk shaped having three or more slots parallel to the axis of the peep and uniformly distributed about the periphery. The faces of the peep sight are parallel to one another and have opposing frustoconical surfaces which are penetrated at their apexes by the sighting hole or peep.

A FOURTH EXAMPLE, U.S. Pat. No. 5,080,084 to Kendall et al. teaches a peep sight for use with an archer's bow that is fabricated from a non-opaque material to which a light enhancing color has been added. The available light is thereby intensified in the peep sight so that visibility is increased at low light levels. The peep sight has four notched corners for mounting the peep sight on the bowstring. When so mounted the strands of the bowstring do not obstruct the visions of the archer. Furthermore, the peep hole in the peep sight may be angled to increase the field of vision of the archer. A dark annular ledge is provided about the peep hole to further improve viewing definition through the peep sight. In a second embodiment, a source of energy, and a light source connected to the peep sight by a fiber optic cord also provides a peep sight for improved visibility for the archer.

A FIFTH EXAMPLE, U.S. Pat. No. 5,157,839 to Beutler teaches a rear peep sight apparatus for use with a bow that includes a body formed of a transparent material for mounting in a bow string. The body has generally parallel front and rear surfaces connected by a curved side surface and the side surface and a portion of each of the front and rear surfaces is opaque. The body has a cavity formed therein for mounting a light source which is connected by a spiral wound elastic conductor to a battery and switch enclosed in a housing which can be releasably attached to the bow. The peep sight can include sighting means such as, for example, an oval ring, a dot and a cross hair. In the alternative, the light source can be located in the housing and the light transmitted through a fiber optic conductor to the body.

A SIXTH EXAMPLE, U.S. Pat. No. 5,325,598 to Hall et al. teaches a bowstring mounted peep sight having a peep housing that is frictionally located between displaced bowstring filaments. The peep housing defines a peep hole and a transverse oriented receiving slot. Insertable aperture reducing discs are slidably inserted into the receiving slot to incrementally decrease the relative aperture of the peep hole. To prevent the inserts from being inadvertently dislodged from the receiving slot during use of the invention, one of the displaced bowstring elements is positioned so as to prevent the disc from sliding outwardly therefrom. Because of the design of the peep housing, lightweight materials can be utilized. Frusto conical recesses on both planar surfaces of the peep housing reduce incidental glare thereby increasing the clarity of the observed target.

A SEVENTH EXAMPLE, U.S. Pat. No. 5,996,569 to Wilson teaches an improved rear bow sight used in archery. The present invention is a bowstring mounted rear peep sight formed of clear, preferably acrylic, material. The transparent characteristic of the present invention allows the archer to align the rear bow sight with the forward sight pin, while remaining focused on the position on the target at which the archer is aiming. A second embodiment of the present invention includes an ambient light collecting fiber which acts as a rear transparent sight pin within a sight window. The light collecting fiber is wrapped about the sight in order to collect ambient light, while the second end of the fiber acts as the sight pin and is centrally positioned within the sight window. The sight pin provides an illumination point for alignment with a forward sight in order to set proper aim at a target. A third embodiment of the present invention uses a surface to help contrast the illumination point of the sight pin against the surrounding environment in order to better view the sight pin. Another embodiment uses two fibers as pin sights along with an enlarged contrasting member to enhance visibility of the pin sight.

It is apparent that numerous innovations for bow sights have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a rear peep sight for mounting to a string of a bow and having interchangeable sight ports for accommodating different user preferences that avoids the disadvantages of the prior art.

ANOTHER OBJECT of the present invention is to provide a rear peep sight for mounting to a string of a bow and having interchangeable sight ports for accommodating different user preferences that is simple to use.

BRIEFLY STATED, STILL ANOTHER OBJECT of the present invention is to provide a rear peep sight for mounting to a string of a bow and having interchangeable sight ports for accommodating different user preferences. A mounting member mounts to the string of the bow and a sighting member is interchangeably attached to the mounting member so as to accommodate different user preferences of sight ports. The mounting member has a channel that slidably receives the sighting member so as to provide a dove-tail joint that prevents the sighting member from vertical movement, yet allows for horizontal movement so as to allow the sighting member to slide sideways into the channel. The sighting member has an auxiliary through bore and a pimple that align with, and engage with, respectively, a pair of through bores in the mounting member. A screw extends freely through one through bore in the mounting member and threadably into the auxiliary through bore so as to maintain prevention of the sighting member from horizontal movement.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figure 1:
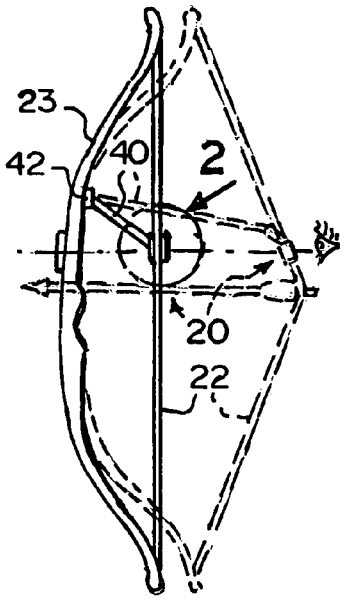
FIG. 1 is a diagrammatic side elevational view of the present invention in use.

20 rear peep sight of present invention for mounting to string 22 of bow 23 and having interchangeable sight ports for accommodating different user preferences
22 string of bow 23
23 bow
24 mounting member for mounting to string 22 of bow 23
26 sighting member
28 forward-facing surface of mounting member 24
30 rearward-facing surface of mounting member 24
32 pair of sideward-facing surfaces of mounting member 24
34 pair of grooves in pair of sideward-facing surfaces 32 of mounting member 24, respectively, for tightly receiving string 22 of bow 23 so as to thereby mount rear peep sight 20 to string 22 of bow 23
35 sighting through bore in mounting member 24
36 alignment arm of mounting member 24 for reducing and helping prevent twisting or axial rotation of rear peep sight 20 about string 22 of bow 23
38 terminal free end of alignment arm of mounting member 24
40 elastic cord
42 mount
44 visor of mounting member 24 for reducing glare
46 channel in rearward-facing surface 30 of mounting member 24
48 upper wall defining channel 46 in rearward-facing surface 30 of mounting member 24
50 lower wall defining channel 46 in rearward-facing surface 30 of mounting member 24
51 pair of through bores in mounting member 24
52 plate of sighting member 26
54 forward-facing surface of plate 52 of sighting member 26
56 rearward-facing surface of plate 52 of sighting member 26
58 upper-facing surface of plate 52 of sighting member 26
60 lower-facing surface of plate 52 of sighting member 26
62 sighting through bore in plate 52 of sighting member 26
64 auxiliary through bore in plate 52 of sighting member 26
66 pimple of plate 52 of sighting member 26
68 screw of sighting member 26

DETAILED DESCRIPTION OF THE INVENTION

Referring now to the figures, in which like numerals indicate like parts, and particularly to FIG. 1, the rear peep sight of the present invention is shown generally at 20 for mounting to a string 22 of a bow 23 and having interchangeable sight ports for accommodating different user preferences.

Figure 2:
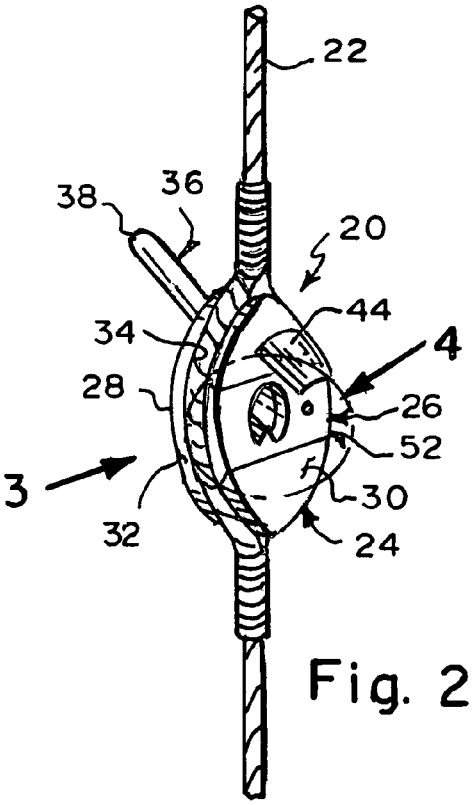
FIG. 2 is an enlarged diagrammatic perspective view of the area generally enclosed by the dotted curve identified by ARROW 2 in FIG. 1 of the present invention.
Figure 3:
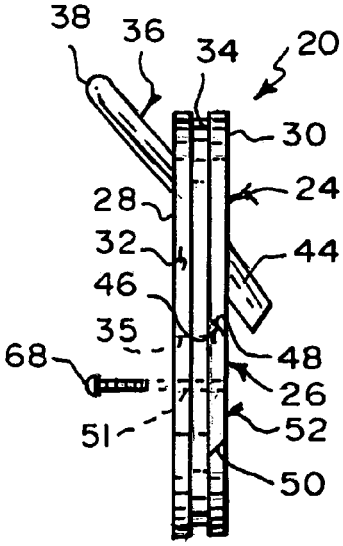
FIG. 3 is an enlarged diagrammatic side elevational view taken generally in the direction of ARROW 3 in FIG. 2.
Figure 4:
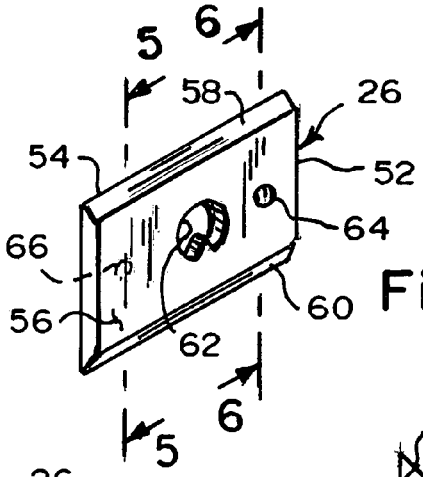
FIG. 4 is an enlarged diagrammatic perspective view of the area generally enclosed by the dotted curve identified by ARROW 4 in FIG. 2 of a typical interchangeable sighting member of the present invention.
Figure 5:
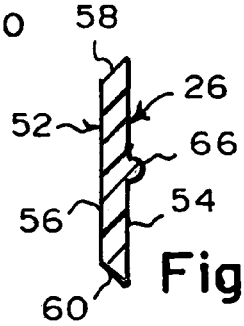
FIG. 5 is an enlarged diagrammatic cross sectional view taken along LINE 5—5 in FIG. 4.
Figure 6:
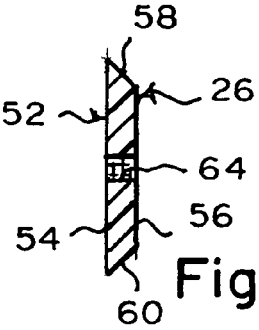
FIG. 6 is an enlarged diagrammatic cross sectional view taken along LINE 6—6 in FIG. 4.
Figure 7:
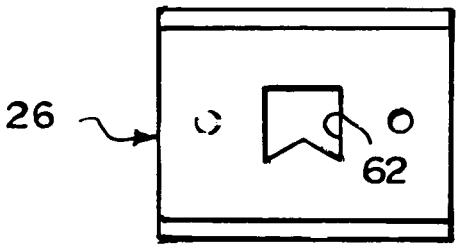
FIGS. 7–13 are diagrammatic front elevational views of other interchangeable sighting members utilized in place of the interchangeable sighting member shown in FIG. 4 of the present invention.
Figure 8:
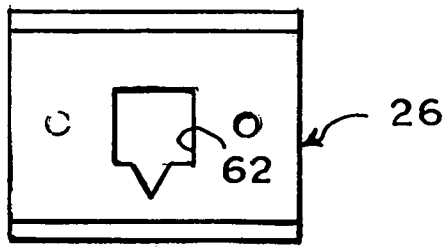
Figure 9:
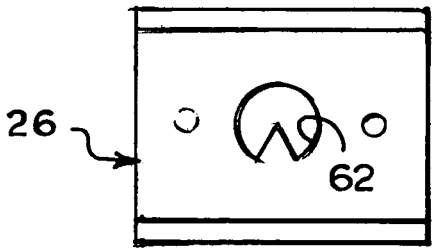
Figure 10:
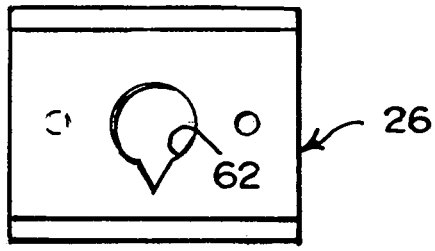
Figure 11:
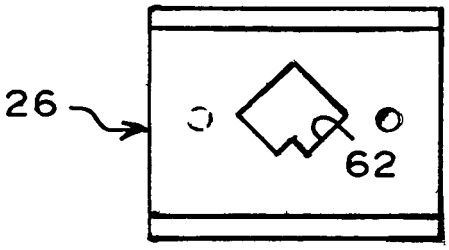
Figure 12:
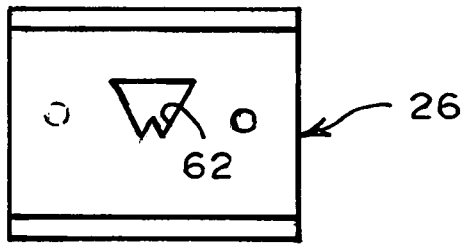
Figure 13:
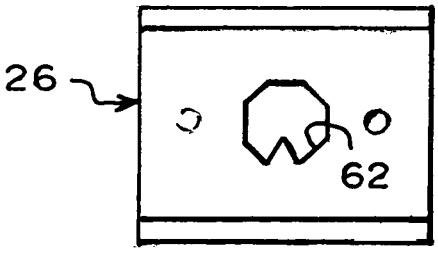

The general configuration of the rear peep sight 20 can best be seen in FIGS. 2 and 3, and as such, will be discussed with reference thereto.

The rear peep sight 20 comprises a mounting member 24 and a sighting member 26. The mounting member 24 is for mounting to the string 22 of the bow 23 and the sighting member 26 is attached to the mounting member 24.

The sighting member 26 is interchangeably attached to the mounting member 24 so as to accommodate different user preferences of sight ports.

The specific configuration of the mounting member 24 can best be seen in FIGS. 2 and 3, and as such, will be discussed with reference thereto.

The mounting member 24 is generally oval-shaped, vertically-oriented, and has a forward-facing surface 28, a rearward-facing surface 30, and a pair of sideward-facing surfaces 32.

The pair of sideward-facing surfaces 32 of the mounting member 24 have a pair of grooves 34 running therealong, respectively. The pair of grooves 34 in the pair of sideward-facing surfaces 32 of the mounting member 24, respectively, are for tightly receiving the string 22 of the bow 23 so as to thereby mount the rear peep sight 20 to the string 22 of the bow 23.

The mounting member 24 further has a sighting through bore 35. The sighting through bore 35 in the mounting member 24 extends substantially centrally through the mounting member 24, from the forward-facing surface 28 of the mounting member 24 to the rearward-facing surface 30 of the mounting member 24.

The mounting member 24 further has an alignment arm 36. The alignment arm 36 of the mounting member 24 is for reducing and helping prevent twisting or axial rotation of the rear peep sight 20 about the string 22 of the bow 23, and is slender, elongated, rod-like, and extends incliningly upwardly from the forward-facing surface 28 of the mounting member 24, above the sighting through bore 35 in the mounting member 24, to a terminal free end 38.

An elastic cord 40 is attached to the terminal free end 38 of the alignment arm 36 of the mounting member 24 and extends therefrom for attaching to the bow 23 by a mount 42 (FIG. 1), and by so doing, as the string 22 of the bow 23 is drawn rearward, the elastic cord 40 urges the alignment arm 36 into alignment with the bow 23, thus precluding axial twist of the rear peep sight 20 about the string 22 of the bow 23 and keeping the sighting member 26 disposed generally perpendicular to a line of sight of an archer.

Preferably, the alignment arm 36 extends along a plane which is thirty-five degrees from a plane in which the mounting member 24 lies.

The mounting member 24 further has a visor 44. The visor 44 of the mounting member 24 is for reducing glare, is convex-concave-shaped, and extends incliningly downwardly from the rearward-facing surface 30 of the mounting member 24, above the sighting through bore 35 in the mounting member 24, but below the elevation of the alignment arm 36 of the mounting member 24.

The rearward-facing surface 30 of the mounting member 24 has a channel 46. The channel 46 extends transversely in the rearward-facing surface 30 of the mounting member 24, from and opening into one side surface of the pair of side surfaces 32 of the mounting member 24 to and opening into the other side surface of the pair of side surfaces 32 of the mounting member 24, and communicates with the sighting through bore 35 in the mounting member 24.

The channel 46 in the rearward-facing surface 30 of the mounting member 24 is defined by an upper wall 48 and a lower wall 50. The upper wall 48 and the lower wall 50 defining the channel 46 in the rearward-facing surface 30 of the mounting member 24 both extend transversely across the rearward-facing surface 30 of the mounting member 24.

The upper wall 48 defining the channel 46 in the rearward-facing surface 30 of the mounting member 24 extends forwardly and upwardly in the rearward-facing surface 30 of the mounting member 24 and the lower wall 50 defining the channel 46 in the rearward-facing surface 30 of the mounting member 24 extends forwardly and downwardly in the rearward-facing surface 30 of the mounting member 24 so as to allow the channel 46 in the rearward-facing surface 30 of the mounting member 24 to diverge forwardly.

The mounting member 24 further has a pair of through bores 51. The pair of through bores 51 in the mounting member 24 are not threaded, and extend laterally through the mounting member 24, from the forward-facing surface 28 of the mounting member 24 to the rearward-facing surface 30 of the mounting member 24, are horizontally-aligned with each other, and straddle the sighting through bore 35 in the mounting member 24.

The specific configuration of the sighting member 26 can best be seen in FIGS. 2–6, and as such, will be discussed with reference thereto.

The sighting member 26 is a plate 52. The plate 52 of the sighting member 26 is slidably received in the channel 46 in the rearward-facing surface 30 of the mounting member 24, from either sideward-facing surface of the pair of sideward-facing surfaces 32 of the mounting member 24, and is generally rectangular-shaped, horizontally-oriented, and has a forward-facing surface 54, a rearward-facing surface 56, an upper-facing surface 58, and a lower-facing surface 60.

The upper-facing surface 58 of the plate 52 of the sighting member 26 extends forwardly and upwardly from the rearward-facing surface 56 of the plate 52 of the sighting member 26 to the forward-facing surface 54 of the plate 52 of the sighting member 26 and the lower-facing surface 60 of the plate 52 of the sighting member 26 extends forwardly and downwardly from the rearward-facing surface 56 of the plate 52 of the sighting member 26 to the forward-facing surface 54 of the plate 52 of the sighting member 26 so as to allow the plate 52 of the sighting member 26 to converge rearwardly.

The upper-facing surface 58 of the plate 52 of the sighting member 26 is captured by the upper wall 48 defining the channel 46 in the rearward-facing surface 30 of the mounting member 24 and the lower-facing surface 60 of the plate 52 of the sighting member 26 is captured by the lower wall 50 defining the channel 46 in the rearward-facing surface 30 of the mounting member 24 when the plate 52 of the sighting member 26 is slid sideways into the channel 46 in the rearward-facing surface 30 of the mounting member 24 so as to provide a dove-tail joint that prevents the plate 52 of the sighting member 26 from vertical movement once the plate 52 of the sighting member 26 is in the channel 46 in the rearward-facing surface 30 of the mounting member 24, yet allows for horizontal movement so as to allow the plate 52 of the sighting member 26 to slide sideways into the channel 46 in the rearward-facing surface 30 of the mounting member 24.

The plate 52 of the sighting member 26 further has a sighting through bore 62. The sighting through bore 62 in the plate 52 of the sighting member 26 extends substantially centrally through the plate 52 of the sighting member 26, from the rearward-facing surface 56 of the plate 52 of the sighting member 26 to the forward-facing surface 54 of the plate 52 of the sighting member 26, and is aligned with the sighting through bore 35 in the mounting member 24 once the plate 52 of the sighting member 26 is in the channel 46 in the rearward-facing surface 30 of the mounting member 24.

The sighting through bore 62 in the plate 52 of the sighting member 26 has a shape for accommodating different user preferences.

The plate 52 of the sighting member 26 further has an auxiliary through bore 64. The auxiliary through bore 64 in the plate 52 of the sighting member 26 is threaded, and extends through the plate 52 of the sighting member 26, from the rearward-facing surface 56 of the plate 52 of the sighting member 26 to the forward-facing surface 54 of the plate 52 of the sighting member 26, is positioned to one side of the sighting through bore 62 in the plate 52 of the sighting member 26, and is aligned with one through bore of the pair of through bores 51 in the mounting member 24 once the plate 52 of the sighting member 26 is in the channel 46 in the rearward-facing surface 30 of the mounting member 24.

The plate 52 of the sighting member 26 further has a pimple 66. The pimple 66 of the plate 52 of the sighting member 26 extends rearwardly from the rearward-facing surface 56 of the plate 52 of the sighting member 26, is positioned to the other side of the sighting through bore 62 in the plate 52 of the sighting member 26, is horizontally-aligned with the auxiliary through bore 64 in the plate 52 of the sighting member 26, and is engaged by the other through bore of the pair of through bores 51 in the mounting member 24 once the plate 52 of the sighting member 26 is in the channel 46 in the rearward-facing surface 30 of the mounting member 24 so as to prevent the plate 52 of the sighting member 26 from horizontal movement once the plate 52 of the sighting member 26 is in the channel 46 in the rearward-facing surface 30 of the mounting member 24.

The sighting member 26 further has a screw 68. The screw 68 of the sighting member 26 extends freely through one through bore of the pair of through bores 51 in the mounting member 24, from the forward-facing surface 28 of the mounting member 24, and threadably into the auxiliary through bore 64 in the plate 52 of the sighting member 26, from the forward-facing surface 54 of the plate 52 of the sighting member 26, so as to maintain prevention of the plate 52 of the sighting member 26 from horizontal movement once the plate 52 of the sighting member 26 is in the channel 46 in the rearward-facing surface 30 of the mounting member 24.

It is to be understood that since the pair of through bores 51 in the mounting member 24 are not threaded and the auxiliary through bore 64 in the plate 52 of the sighting member 26 is threaded and horizontally-aligned with the pimple 66 of the plate 52 of the sighting member 26, the plate 52 of the sighting member 26 can be positioned either right-side-up upside-down in the channel 46 in the rearward-facing surface 30 of the mounting member 24 depending upon what shape a user desires for the sighting through bore 62 in the plate 52 of the sighting member 26.

FIGS. 7–13 illustrate various interchangeable sighting members 26 having different shaped sighting through bores 62.

It will be understood that each of the elements described above, or two or more together, may also find a useful application in other types of constructions differing from the types described above.

While the invention has been illustrated and described as embodied in a rear peep sight for mounting to a string of a bow and having interchangeable sight ports for accommodating different user preferences, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A rear peep sight for mounting to a string of a bow and having interchangeable sight ports for accommodating different user preferences, said sight comprising:

a) a mounting member; and b) a sighting member;

wherein said mounting member is for mounting to the string of the bow; and wherein said sighting member is attached to said mounting member, wherein said mounting member has a forward-facing surface;

wherein said mounting member has a rearward-facing surface; and wherein said mounting member has a pair of sideward-facing surfaces, wherein said mounting member has a sighting through bore;

wherein said sighting through bore in said mounting member extends substantially centrally through said mounting member; and wherein said sighting through bore in said mounting member extends from said forward-facing surface of said mounting member to said rearward-facing surface of said mounting member, wherein said rearward-facing surface of said mounting member has a channel;

wherein said channel extends transversely in said rearward-facing surface of said mounting member;

wherein said channel in said rearward-facing surface of said mounting member extends from one side surface of said pair of side surfaces of said mounting member to the other side surface of said pair of side surfaces of said mounting member;

wherein said channel in said rearward-facing surface of said mounting member opens into said one side surface of said pair of side surfaces of said mounting member;

wherein said channel in said rearward-facing surface of said mounting member opens into said other side surface of said pair of side surfaces of said mounting member; and wherein said channel in said rearward-facing surface of said mounting member communicates with said sighting through bore in said mounting member.

2. The sight as defined in claim 1, wherein said sighting member is interchangeably attached to said mounting member so as to accommodate different user preferences of sight ports.

3. The sight as defined in claim 1, wherein said mounting member is generally oval-shaped; and wherein said mounting member is vertically-oriented.

4. The sight as defined in claim 1, wherein said pair of sideward-facing surfaces of said mounting member have a pair of grooves running therealong, respectively; and wherein said pair of grooves in said pair of sideward-facing surfaces of said mounting member, respectively, are for tightly receiving the string of the bow so as to thereby mount said rear peep sight to the string of the bow.

5. The sight as defined in claim 1, wherein said mounting member has an alignment arm;

wherein said alignment arm of said mounting member is for reducing and helping prevent twisting or axial rotation of said rear peep sight about the string of the bow; and wherein said alignment arm of said mounting member extends inclingly upwardly from said forward-facing surface of said mounting member, above said sighting through bore in said mounting member, to a terminal free end.

6. The sight as defined in claim 5, wherein said alignment arm of said mounting member is slender;

wherein said alignment arm of said mounting member is elongated; and wherein said alignment arm of said mounting member is rod-like.

7. The sight as defined in claim 6; further comprising an elastic cord; wherein said elastic cord is attached to said terminal free end of said alignment arm of said mounting member; and wherein said elastic cord extends from said terminal free end of said alignment arm of said mounting member for attaching to the bow by a mount, and by so doing, as the string of the bow is drawn rearward, said elastic cord urges said alignment arm into alignment with the bow, thus precluding axial twist of said rear peep sight about the string of the bow and keeping said sighting member disposed generally perpendicular to a line of sight of an archer.

8. The sight as defined in claim 5, wherein said alignment arm extends along a plane which is thirty-five degrees from a plane in which said mounting member lies.

9. The sight as defined in claim 5, wherein said mounting member has a visor;

wherein said visor of said mounting member is for reducing glare;

wherein said visor of said mounting member extends incliningly downwardly from said rearward-facing surface of said mounting member;

wherein said visor of said mounting member is disposed above said sighting through bore in said mounting member; and wherein said visor of said mounting member is disposed below the elevation of said alignment arm of said mounting member.

10. The sight as defined in claim 9, wherein said visor of said mounting member is convex-concave-shaped.

11. The sight as defined in claim 1, wherein said channel in said rearward-facing surface of said mounting member is defined by an upper wall;

wherein said channel in said rearward-facing surface of said mounting member is defined by a lower wall; and wherein said upper wall and said lower wall defining said channel in said rearward-facing surface of said mounting member both extend transversely across said rearward-facing surface of said mounting member.

12. The sight as defined in claim 11, wherein said upper wall defining said channel in said rearward-facing surface of said mounting member extends forwardly and upwardly in said rearward-facing surface of said mounting member and said lower wall defining said channel in said rearward-facing surface of said mounting member extends forwardly and downwardly in said rearward-facing surface of said mounting member so as to allow said channel in said rearward-facing surface of said mounting member to diverge forwardly.

13. The sight as defined in claim 11, wherein said mounting member has a pair of through bores;

wherein said pair of through bores in said mounting member extend laterally through said mounting member; and wherein said pair of through bores in said mounting member extend from said forward-facing surface of said mounting member to said rearward-facing surface of said mounting member.

14. The sight as defined in claim 13, wherein said pair of through bores in said mounting member are horizontally-aligned with each other.

15. The sight as defined in claim 13, wherein said pair of through bores in said mounting member straddle said sighting through bore in said mounting member.

16. The sight as defined in claim 13, wherein said pair of through bores in said mounting member are not threaded.

17. The sight as defined in claim 13, wherein said sighting member is a plate.

18. The sight as defined in claim 17, wherein said plate of said sighting member is slidably received in said channel in said rearward-facing surface of said mounting member, from either sideward-facing surface of said pair of sideward-facing surfaces of said mounting member.

19. The sight as defined in claim 17, wherein said plate of said sighting member is generally rectangular-shaped; and wherein said plate of said sighting member is horizontally-oriented.

20. The sight as defined in claim 17, wherein said plate of said sighting member has a forward-facing surface;

wherein said plate of said sighting member has a rearward-facing surface;

wherein said plate of said sighting member has an upper-facing surface; and wherein said plate of said sighting member has a lower-facing surface.

21. The sight as defined in claim 20, wherein said upper-facing surface of said plate of said sighting member extends forwardly and upwardly from said rearward-facing surface of said plate of said sighting member to said forward-facing surface of said plate of said sighting member and said lower-facing surface of said plate of said sighting member extends forwardly and downwardly from said rearward-facing surface of said plate of said sighting member to said forward-facing surface of said plate of said sighting member so as to allow said plate of said sighting member to converge rearwardly.

22. The sight as defined in claim 20, wherein said upper-facing surface of said plate of said sighting member is captured by said upper wall defining said channel in said rearward-facing surface of said mounting member and said lower-facing surface of said plate of said sighting member is captured by said lower wall defining said channel in said rearward-facing surface of said mounting member when said plate of said sighting member is slid sideways into said channel in said rearward-facing surface of said mounting member so as to provide a dove-tail joint that prevents said plate of said sighting member from vertical movement once said plate of said sighting member is in said channel in said rearward-facing surface of said mounting member, yet allows for horizontal movement so as to allow said plate of said sighting member to slide sideways into said channel in said rearward-facing surface of said mounting member.

23. The sight as defined in claim 20, wherein said plate of said sighting member has a sighting through bore;

wherein said sighting through bore in said plate of said sighting member extends substantially centrally through said plate of said sighting member;

wherein said sighting through bore in said plate of said sighting member extends from said rearward-facing surface of said plate of said sighting member to said forward-facing surface of said plate of said sighting member; and wherein said sighting through bore in said plate of said sighting member is aligned with said sighting through bore in said mounting member once said plate of said sighting member is in said channel in said rearward-facing surface of said mounting member.

24. The sight as defined in claim 23, wherein said sighting through bore in said plate of said sighting member has a shape for accommodating different user preferences.

25. The sight as defined in claim 23, wherein said plate of said sighting member has an auxiliary through bore;

wherein said auxiliary through bore in said plate of said sighting member extends through said plate of said sighting member, from said rearward-facing surface of said plate of said sighting member to said forward-facing surface of said plate of said sighting member;

wherein said auxiliary through bore in said plate of said sighting member is positioned to one side of said sighting through bore in said plate of said sighting member; and wherein said auxiliary through bore in said plate of said sighting member is aligned with one through bore of said pair of through bores in said mounting member once said plate of said sighting member is in said channel in said rearward-facing surface of said mounting member.

26. The sight as defined in claim 25, wherein said auxiliary through bore in said plate of said sighting member is threaded.

27. The sight as defined in claim 26, wherein said plate of said sighting member has a pimple;

wherein said pimple of said plate of said sighting member extends rearwardly from said rearward-facing surface of said plate of said sighting member;

wherein said pimple of said plate of said sighting member is positioned to the other side of said sighting through bore in said plate of said sighting member;

wherein said pimple of said plate of said sighting member is horizontally-aligned with said auxiliary through bore in said plate of said sighting member; and wherein said pimple of said plate of said sighting member is engaged by the other through bore of said pair of through bores in said mounting member once said plate of said sighting member is in said channel in said rearward-facing surface of said mounting member so as to prevent said plate of said sighting member from horizontal movement once said plate of said sighting member is in said channel in said rearward-facing surface of said mounting member.

28. The sight as defined in claim 27, wherein said plate of said sighting member is positioned either right-side-up or up-side-down in said channel in said rearward-facing surface of said mounting member depending upon what shape a user desires for said sighting through bore in said plate of said sighting member by virtue of said pair of through bores in said mounting member not being threaded and said auxiliary through bore in said plate of said sighting member being threaded and horizontally-aligned with said pimple of said plate of said sighting member.

29. The sight as defined in claim 25, wherein said sighting member has a screw; and wherein said screw of said sighting member extends freely through one through bore of said pair of through bores in said mounting member, from said forward-facing surface of said mounting member, and threadably into said auxiliary through bore in said plate of said sighting member, from said forward-facing surface of said plate of said sighting member, so as to maintain prevention of said plate of said sighting member from horizontal movement once said plate of said sighting member is in said channel in said rearward-facing surface of said mounting member.

* * * * *